US005301786A

United States Patent [19]

Yoshihara

[11] Patent Number: 5,301,786

[45] Date of Patent: Apr. 12, 1994

[54] METHOD AND APPARTUS FOR VALIDATING A PAPER-LIKE PIECE

[75] Inventor: Kenzo Yoshihara, Kounosu, Japan

[73] Assignee: Nippon Conlux Co., Ltd., Tokyo, Japan

[21] Appl. No.: 988,010

[22] Filed: Dec. 9, 1992

Related U.S. Application Data

[63] Continuation of Ser. No. 539,913, Jun. 18, 1990, abandoned.

[30] Foreign Application Priority Data

Jun. 19, 1989 [JP] Japan ..... 1-154535

[51] Int. Cl.[5] ..... G07D 7/00

[52] U.S. Cl. ..... 194/207; 250/562

[58] Field of Search ..... 194/207; 209/534, 588; 250/562; 356/71

[56] References Cited

U.S. PATENT DOCUMENTS 4,588,292 5/1986 Collins ..... 209/534 X 4,618,257 10/1986 Bayne et al. ..... 209/534 X 4,881,268 11/1989 Uchida et al. ..... 356/71 X

*Primary Examiner*—F. J. Bartuska

*Attorney, Agent, or Firm*—Graham & James

[57] ABSTRACT

An apparatus and method for validating a paper-like piece are of a type having a detector which irradiates light onto a deposited paper-like piece and thereby produces a detection signal corresponding to a pattern on the paper-like piece and validating the paper-like piece by collating the detection signal produced by the detector in response to deposition of the paper-like piece with a predetermined standard pattern. Features of the apparatus and method are that a reference paper-like piece having no particular pattern is deposited and reference level data is obtained on the basis of a detection signal produced by the detector in response to this deposition, that data to be examined is provided by converting a detection signal produced by the detector in response to deposition of a paper-like piece to be validated to a ratio to or deviation from the reference level data and that validation is made by collating this data to be examined with the standard pattern. Since the base for normalizing measured data for collation is set at the level of the reference paper-like piece, validation becomes less vulnerable to adverse effects by a parts error and an assembling error in an optical type detector with resulting improvement in the validation accuracy.

9 Claims, 4 Drawing Sheets

METHOD AND APPARTUS FOR VALIDATING A PAPER-LIKE PIECE

This is a continuation of copending application Ser. No. 07/539,913 filed on Jun. 18, 1990 now abandoned.

BACKGROUND OF THE INVENTION

This invention relates to an apparatus for validating a paper-like piece such as a bill or bank note, a note used as a substitute for money, a gift card, or a bill made of plastics and a collation method in such apparatus and, more particularly, to such apparatus and method capable of performing accurate validation and collation taking into account errors present in individual parts of an optical sensor or in assembling of these parts.

In this specification, the term "a paper-like piece" means a paper-like piece having a face value or identifying function such as a bill or bank note made of paper or plastics, a note used as a substitute for money, a gift card or an identification certificate.

As a sensor used in known validators, there is an optical sensor including a light-emitting element and a light-receiving element. In this type of optical sensor, a bill is passed, for example, between the light-emitting element and the light-receiving element and the amount of transmitted light corresponding to the design on the bill is detected, and the pattern on the bill is collated on the basis of the detected amount of transmitted light to validate the bill. There is also proposed a method of detecting the amount of reflected light in accordance with the pattern on the bill. As examples of such prior art optical type bill validator or bill validating method, there are publications including Japanese Patent Publication No. 41-20245, Japanese Utility Model Publication No. 43-23522, Japanese Patent Publication No. 53-39151, Japanese Patent Application Laid-open No. 54-5496 and Japanese Patent Application Laid-open No. 60-61883.

Japanese Patent Publication No. 41-20245 and Utility Model Publication No. 43-23522 disclose a general art of validating a bill by comparing a received light signal corresponding to the pattern of the bill with a predetermined reference pattern. Japanese Patent Publication No. 53-39151, Patent Application Laid-open No. 54-5496, Patent Application Laid-open No. 60-61883 and others disclose a technique for coping with variation in the received light level occurring due to variations in the measuring conditions which are resultant from aging and thermal property of the light-emitting and light-receiving elements and deposition of soil on a bill.

A typical example of the prior art for coping with variation in the received light level due to variations in measuring conditions is a method according to which the received light signal level in a stand-by mode (i.e., a mode in which a bill has not been inserted in the validator) is measured, and then a pattern of a bill is normalized on the basis of the measured value. In other words, reference pattern data is prepared in the form of a ratio of a received light signal level corresponding to a detected pattern, to a received light signal level in the stand-by mode. The received light signal level in the stand-by mode (current stand-by mode level) is measured at each occasion of detection, then a received light signal level corresponding to the pattern of an inserted bill which is measured at each occasion of detection is converted to the ratio to the current stand-by mode level and this ratio is compared with the reference pattern data. In short, the received light signal level which is an absolute value is converted to a relative value based on the stand-by mode for collation.

In the above described prior art method, no serious problem arises in cases where a high degree of accuracy of validation is not required. In a case where a high degree of accuracy of validation is required, however, the following problem will arise. In a case, for example, where a magnetic validation device performing validation by detecting a magnetic component in printing ink is provided in addition to the optical type validation device for improving the accuracy of validation, the accuracy of validation by the optical validation device per se may be relatively rough. In a case where no magnetic component exists in the printing ink, however, there is no means for improving the accuracy of validation but performing an accurate validation with the use of the optical type validation device and, accordingly, a high degree of accuracy of validation by the optical type validation device per se is required.

A problem caused by the optical type validation device is a problem caused by a parts error and an assembling error of the optical sensor. The parts error is an error in individual elements such as a light-emitting element and a light-receiving element which are used as parts of an optical sensor. Even if each part is made so as to satisfy a certain standard, there is an irregularity between individual elements within the standard. Accordingly, the amount of emitted light may differ from element to element even if the same input electrical signal is given, or output electrical signals may differ even if the same amount of light is received, or the irradiation field pattern of the light-emitting element may differ from element to element. This is the parts error. The assembling error is an irregularity in the accuracy of assembling of parts of an optical sensor, that is, the relation between the irradiation field of the light-emitting element and the position of the light-receiving element differs slightly from one optical sensor to another due to irregularity in assembling of the parts.

FIGS. 12*a*–12*c* show, as an example of the parts error, irregularities between the irradiation field patterns of individual light-emitting elements. FIG. 12*a* shows an example in which located in the center of a bright circle. FIG. 12*b* shows an example in which a half-bright spot is located in the center of a bright circle and further a bright spot is located in the center of the half-bright spot. FIG. 12*c* shows an example in which a half-bright spot is located at a position slightly offset from the center of a bright circle.

FIGS. 13*a* and 13*b* show, as an example of the assembling error, irregularities in the locational relations between irradiation fields L1 and L2 of a light-emitting element and position R of a light-receiving element. L1 denotes a bright circle and L2 a half-bright spot. FIG. 13*c* shows an example in which there is substantially no assembling error with respect to irradiation field L1, but position R of a light-receiving element with respect to irradiation fields L1 and L2 is offset due to offsetting of the irradiation field L2 with respect to the irradiation field L1.

Such parts and assembling errors adversely affect the output signal level of a light-receiving element. This effect is relatively small when received light is in a saturated or nearly saturated state but becomes remarkable in a moderate light receiving state corresponding to the pattern on a bill.

FIG. 14 shows an example of a light-receiving element's output signal in a light transmitting system. In the stand-by mode, the received light is in a saturated state and the light-receiving element's output signal level is at the maximum. When a bill is passing through an optical sensor, light is interrupted and the light-receiving element output signal level therefore drops and there arises variation in the light-receiving element's output signal level corresponding to the pattern of the bill. By comparing and collating the variation pattern of this light-receiving element's output signal level during passing of the bill with a predetermined reference pattern, the inserted bill is validated. In the figure, solid line X shows an example of a light-receiving element's output signal of a certain apparatus and dotted line Y shows an example of a light-receiving element output signal of another apparatus concerning the same bill. The light-receiving element output signal level differs depending upon the parts error and assembling error in an optical sensor in each apparatus. For example, the light-receiving element output signal level in the stand-by mode is T10W in the solid line X whereas it is T20W in the dotted line Y. The light-receiving element's output signal level during passing of the bill also differs between the solid line X and the dotted line Y. For example, at a point A, the signal level is T10*a* in the solid line X but it is T20*a* in the dotted line Y.

The ratio of the light-receiving element's output signal level during passing of the bill to the light-receiving element's output signal level in the stand-by mode at the point A is T10*a*/T10W in the solid line X and T20*a*/T20W in the dotted line Y. Owing to difference between T10W and T20W and difference between T10*a* and T20*a*, values of the respective ratios are different from each other. If, therefore, common reference pattern data is used, there arises the problem that an accurate validation cannot be performed.

Even if the value of reference pattern data is changed for each apparatus, the conventional normalizing method of obtaining a ratio of the light-receiving element's output signal level during passing of the bill to the light-receiving element's output signal level in the stand-by mode has the problem that the parts and assembling errors affect the accuracy adversely, because one of the output signal levels is a saturated value and the other is an unsaturated value so that difference between the two values is large, thus with a resulting small value of ratio making it difficult to perform an accurate validation, and, further because the effect of the parts and assembling errors is relatively small in the saturated value whereas this effect is remarkable in the unsaturated value. Further, aging due to soil or deterioration of the sensor affects the difference or ratio between the saturated value and the unsaturated value caused by the parts and assembling errors, which becomes one of the reasons for inability of the conventional method to improve the accuracy in validation.

SUMMARY OF THE INVENTION

It is, therefore, an object of the invention to provide a method and an apparatus for validating a paper-like piece capable of performing accurate validation and collation taking into account the parts and assembling errors of an optical sensor.

It is another object of the invention to provide a method and an apparatus for validating a paper-like piece capable of performing accurate validation and collation taking into account the parts and assembling errors regardless of variation in the measuring data due to soil or fatigue of a paper-like piece or soil or deterioration of the sensor.

The apparatus for validating a paper-like piece according to the invention comprises a detection section for producing a detection signal corresponding to a pattern onto a deposited paper-like piece by irradiating light on the paper-like piece, a reference level data providing section for preparing reference level data on the basis of a detection signal produced by said detection section in response to deposition of a reference paper-like piece on which no particular pattern is provided and providing this reference level data, a standard pattern providing section for providing a predetermined standard pattern corresponding to a pattern of a true paper-like piece, a data-to-be-examined providing section for providing data to be examined which is obtained by converting a detection signal produced by said detection section in response to deposition of a paper-like piece to be validated to a ratio to or deviation from the reference level data provided by said reference level data providing section, and a determination section for determining whether the paper-like piece to be validated is true or false by collating the data to be examined provided by said data-to-be examined providing section with the standard pattern provided by said standard pattern providing section.

According to the invention, reference level data for normalization is provided by using a reference paper-like piece having no particular pattern (e.g., a white paper). For this purpose, the reference level data providing section is provided. For providing the reference level data by this reference level data providing section, the reference paper-like piece is deposited and, on the basis of the detection signal produced by the detection section in response to this deposition, the reference level data is obtained.

The standard pattern providing section provides a predetermined standard pattern corresponding to a pattern of a true paper-like piece. This standard pattern is provided not in an absolute value level but in the form of a ratio to or a deviation from the reference level data. The standard pattern may either be one which is established individually for each apparatus or one which is common to all apparatuses.

The data-to-be-examined providing section provides data to be examined by converting a detection signal produced by the detection section in response to deposition of a paper-like piece to a ratio to or deviation from the reference level data. The determination section determines whether the deposited paper-like piece is true or false by collating the data to be examined provided by the data-to-be-examined providing section with the standard pattern provided by the standard pattern providing section.

Since the base for normalizing measured data for collation is not set at a saturation level but set at the level of the reference paper-like piece, validation becomes less vulnerable to adverse effects by the parts and assembling errors in an optical sensor whereby the validation accuracy can be improved.

Besides, since the validation is less vulnerable to adverse effects by the parts and assembling errors of the optical sensor, there is the advantage that the validation accuracy can be improved in a case where common standard pattern data is used for all apparatuses.

In one aspect of the invention, the apparatus for validating a paper-like piece comprises, in addition to the above described elements, a paper-like piece absence level data providing section for providing paper-like piece absence level data in response to the output signal of said detection section produced when a paper-like piece is not deposited, and a reference level data correction section for correcting the reference level data in accordance with difference between initial paper-like piece absence level data which has been provided by said paper-like piece absence level data providing section during the same period of time as the reference level data has been obtained and current paper-like piece absence level data which has currently been provided by said paper-like piece absence level data providing section.

By providing the paper-like piece absence level data providing section and the reference level data correction section, errors caused by temperature change, aging of the sensor, or deposition of soil or dust on the sensor can be successfully eliminated or reduced.

The collation method in a paper-like piece validating apparatus according to the invention comprises a first step in which a reference paper-like piece having no particular pattern is deposited and reference level data is provided on the basis of detection signal produced by a detection section in response to this deposition, a second step in which a predetermined standard pattern corresponding to a pattern of a normal paper-like piece is provided, a third step in which a detection signal produced by the detection section in response to deposition of a paper-like piece to be validated is converted to a ratio to or deviation from the reference level data and this ratio or deviation is provided as data to be examined, and a fourth step in which the data to be examined is collated with the standard pattern to determine whether the deposited paper-like piece is true or false.

Embodiments of the invention will now be described with reference to the accompanying drawings.

BRIEF DESCRIPTION OF THE DRAWINGS

In the accompanying drawings.

DESCRIPTION OF PREFERRED EMBODIMENTS

Figure 1:
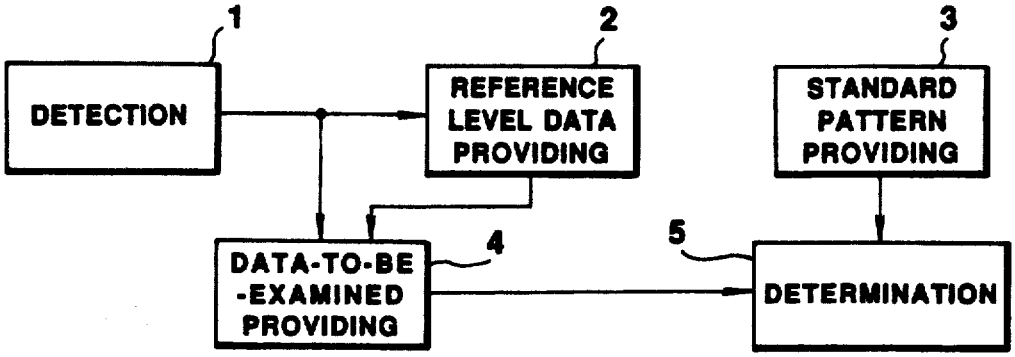
FIGS. 1 and 2 are block diagrams showing a functional construction of an embodiment of the apparatus for validating a paper-like piece according to the invention.

Referring to FIG. 1, reference numeral 1 represents a detection section, 2 a reference level data providing section, 3 a standard pattern providing section, 4 a data-to-be-examined providing section and 5 a determination section, respectively. The reference level data for normalization is provided by using a reference paper-like piece having no particular pattern (e.g., white paper). For this purpose, the reference level data providing section 2 is provided. For providing the reference level data by this reference level data providing section 2, a reference paper-like piece is deposited and reference level data is obtained on the basis of a detection signal produced by the detection section 1 in response to this deposition.

Figure 3:
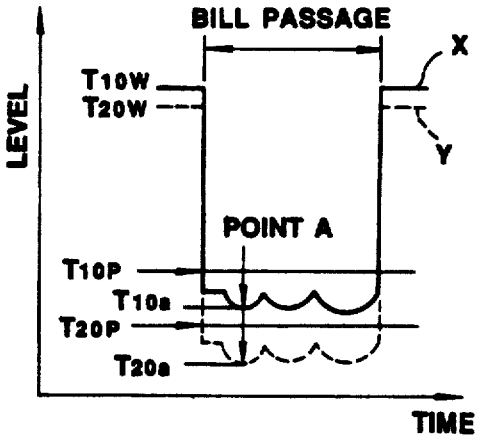
FIG. 3 is a graph showing an example of simulation of a bill detection signal for explaining effects of the parts error and assembling error in an optical type detector in each apparatus.
Figure 14:
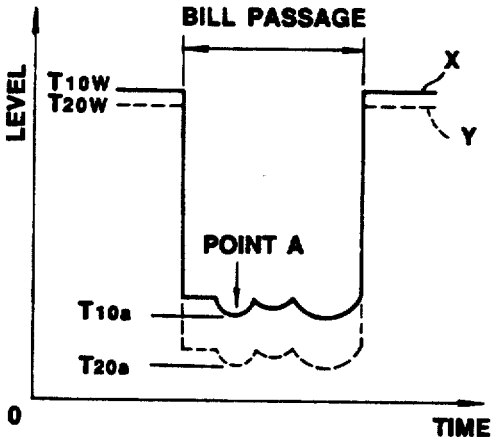
FIG. 14 is a diagram showing an example of an output from a light-receiving element in the light transmission measuring system.

In a case where the light transmission system is employed, the level of received light in the detection section 1 upon deposition of a reference paper-like piece is lower than a saturation level and is in the vicinity of the level of received light upon deposition of a paper-like piece to be examined. FIG. 3 shows an example of reference levels T10P and T20P corresponding to the reference paper-like piece. T10P is an example of reference level corresponding to a paper-like piece which has been detected by an optical type detection section set in a certain apparatus. An example of a pattern of the paper-like piece which has been detected by this detection section is shown by the solid line X. T20P is an example of reference level corresponding to the same reference paper-like piece which has been detected by an optical type detection section set in another apparatus. An example of a pattern of a paper-like piece which has been detected by this detection section is shown by the dotted line Y. In the same manner as in FIG. 14, T10W and T20W are examples of output signal levels of the optical type detection sections in the stand-by mode (i.e., saturation levels) and T10*a* and T20*a* are examples of output signal levels of the optical type detection sections at a point A of the paper-like piece to be examined.

The standard pattern providing section 3 provides a predetermined standard pattern corresponding to a pattern of a paper-like piece to be examined. This standard pattern is provided not as an absolute value level but as a ratio to or deviation from the reference level data. Assuming, for example, that a standard received light signal level value of a paper-like piece to be examined at the point A is represented by T10*a*' and the reference level is represented by T10*p*', the value of the standard pattern corresponding to the point A is provided in the form of a ratio T10*a*'/T10*p*'. This value may also be provided in the form of a deviation T10*p*'–T10*a*'. The standard pattern to be provided in this manner may be a different pattern for each apparatus or may be a common pattern for all apparatuses.

The data-to-be-examined providing section 4 converts a detection sigal produced by the detection section 1 in response to depositon of a paper-like piece to a ratio to or deviation from the reference level data and provides this ratio or deviation as data to be examined. For example, as to a received light signal level value T10*a* of a paper-like piece at the point A in the first described apparatus in the foregoing example, data to be examined is provided in the form of a ratio T10*a*/T10*p* or a deviation T10*p*–T10*a* with respect to the reference level T10*p*. As to a received light signal level value T20*a* in the other apparatus in the foregoing example, data to be examined is provided in the form of a ratio T20*a*/T20*p* or a deviation T20*p*–T20*a* with respect to the reference level T20*p*.

The determination section 5 determines whether the deposited paper-like piece is true or false by collating the data to be examined provided by the data-to-be-examined providing section 4 with the standard pattern provided by the standard pattern providing section 3. Assuming, for example, that a certain common standard pattern is used by the two different apparatuses in the foregoing example, the value of the standard pattern is T10*a*'/T10*p*' with respect to the point A. If a measured value of the point A of a deposited paper-like piece in the first described apparatus, i.e., data to be examined, is T10*a*/T10*p*, these two values are compared and collated with each other. Likewise, if a measured value of the point A of a deposited paper-like piece in the other apparatus is T20*a*/T20*p*, this value is compared and collated with the standard pattern value T10*a*/T10*p*' at the point A.

Since, as described above, the base for normalizing the measured data for collation is not set at a saturation level (e.g., T10W or T20W) but set at the level of the reference paper-like piece (e.g., T10*p* or T20*p*), validation becomes less vulnerable to adverse effects by the parts and assembling errors in an optical sensor used as the detection section 1 whereby the validation accuracy is improved.

Besides, since the validation is less vulnerable to adverse effects by the parts and assembling errors which are peculiar to the optical sensor in each apparatus, the validation accuracy can be improved in a case where common standard pattern data is used for all apparatuses.

Figure 2:
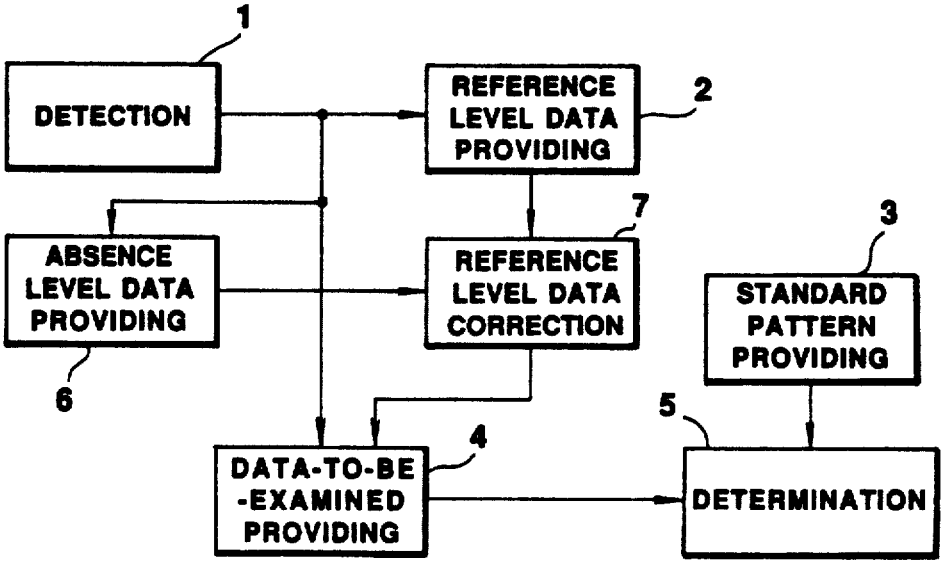

The embodiment of FIG. 2 comprises, in addition to the above described elements, a paper-like piece absence level data providing section 6 for providing paper-like piece absence level data in response to the output signal of said detection section produced when a paper-like piece is not deposited, and a reference level data correction section 7 for correcting the reference level data in accordance with difference between initial paper-like piece absence level data which has been provided by said paper-like piece absence level data providing section 6 during the same period of time as the reference level data has been obtained and current paper-like piece absence level data which has currently been provided by said paper-like piece absence level data providing section 6.

By providing the paper-like piece absence level data providing section 6 and the reference level data correction section 7 as shown in FIG. 2, errors caused by temperature change, aging of the sensor, or deposition of soil or dust on the sensor can be successfully eliminated or reduced.

Figure 4:
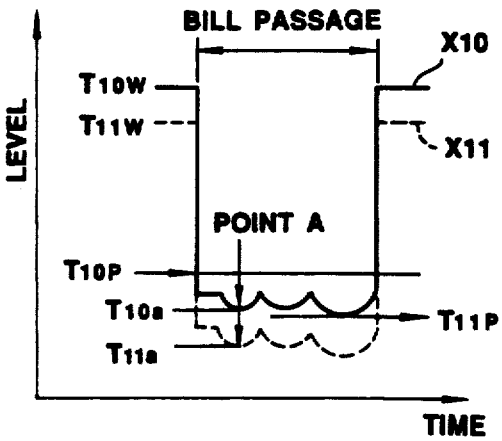
FIG. 4 is a graph showing an example of simulation of a bill detection signal for explaining effects of the output error in an optical type detector caused by environmental change or aging in one and the same apparatus.

An example of correction of reference level data is shown in FIG. 4 in which intial paper-like piece absence level data is represented by T10W and current paper-like piece absence level data reflecting the environmental change and aging is represented by T11W. An example of initial data of a pattern of a paper-like piece to be examined which has been detected by an optical type detection section set in a certain apparatus is shown by a solid line X10 and an example of data reflecting the environmental change and aging in the pattern of the paper-like piece to be examined which has been detected by the optical type detection section in the same apparatus is shown by a dotted line X11. Paper-like piece absence level data in the solid line X10 is represented by T10W and paper-like piece absence level data in the dotted line X11 is represented by T11W. Reference level data is represented by T10*p*.

By way of example of correction by the reference level data correction section 7 in accordance with difference between the current paper-like piece absence level data T11W and the initial paper-like piece absence level data T10W, the reference level data T10*p* can be corrected by a ratio of the current paper-like piece absence level data T11W to the initial paper-like piece absence level data T10W. That is, a correction $T10p \times T11W/T10W = T11p$ is performed. T11*p* represents reference level data after correction. If the current paper-like piece absence level data T11W is not different from the initial paper-like piece absence level data T10W, $T10p = T11p$, i.e., the reference level data T10*p* does not change. Thus, the reference level data is corrected in accordance with change of the current paper-like piece absence level data T11W relative to the initial paper-like piece absence level data T10W whereby the errors in the optical type detection section due to the environmental change and aging can be successfully coped with.

Figure 5:
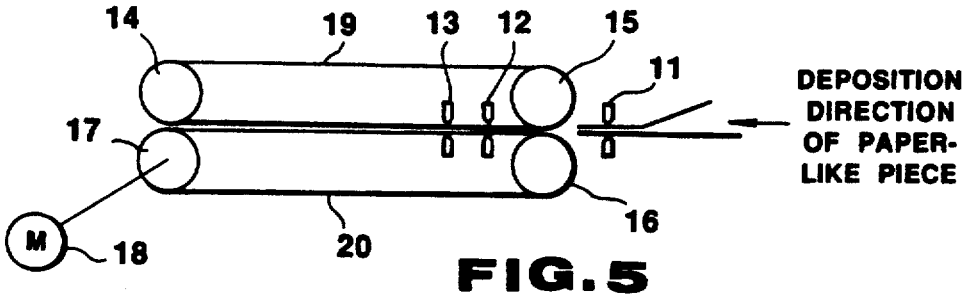
FIG. 5 is a side view showing schematically a mechanical portion in the embodiment of the paper-like piece validating apparatus incorporating the invention.

FIG. 5 is a side view showing a mechanical section of the embodiment of the paper-like validation apparatus according to the invention. In this embodiment, the validation apparatus handles a bill or bank note as the paper-like piece. In the vicinity of an insertion slot is disposed an optical sensor 11 for detecting insertion of a bill. Upon insertion of the bill, the bill is detected by the optical sensor 11 and a motor 18 is driven in a forward direction in response thereto to actuate belts 19 and 20 stretched between pulleys 14, 15 and 16, 17. As the belts 19 and 20 are actuated, the bill held between the belts 19 and 20 is conveyed into the apparatus. In the apparatus, there are provided one or more optical sensors for detecting characteristic features of the bill. In this embodiment, there are provided two optical sensors 12 and 13. These optical sensors 12 and 13 are arranged in different positions in the bill conveying direction so as to detect respective characterizing features of the bill at different positions over the bill. Each of the optical sensors 11, 12 and 13 consists of a pair of a light-emitting element and a light-receiving element and the bill is caused to pass between these light-emitting element and light-receiving element for detection of the amount of transmitted light by the light-receiving element.

Figure 6:
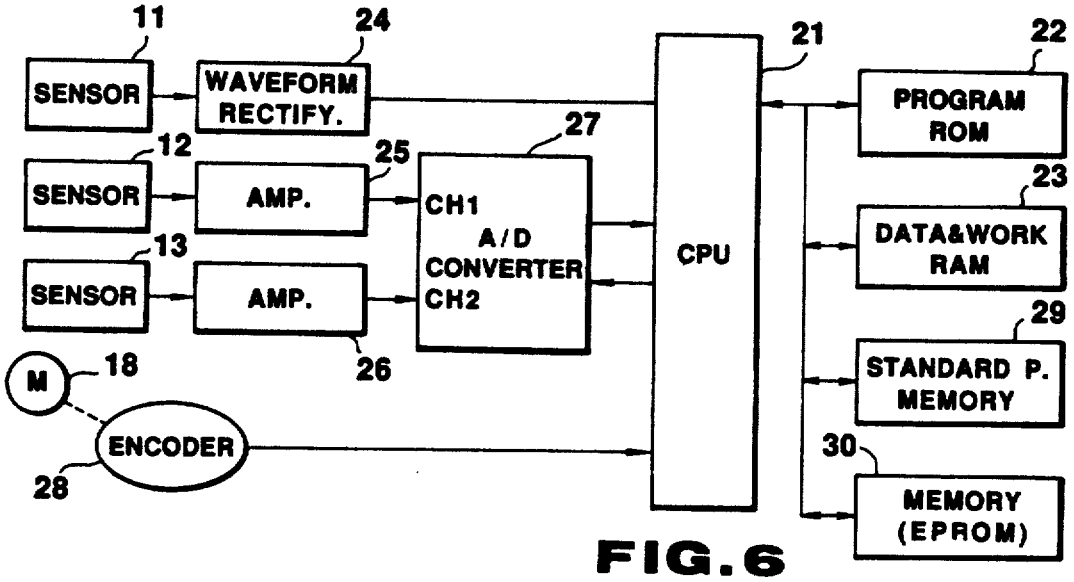
FIG. 6 is a block diagram showing an example of an electrical hardware circuit in a control section of the same embodiment.
Figures 12A, 12B, 12C:
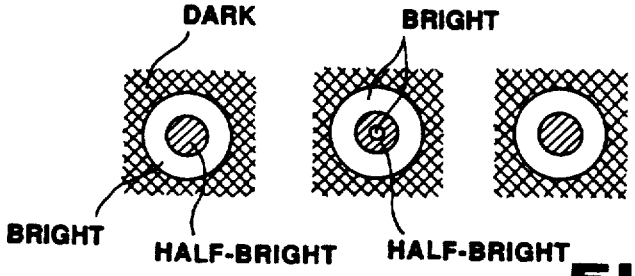
FIGS. 12*a*–12*c* are diagrams showing irregularity in the irradiation field of respective light-emitting elements for illustrating an example of the parts error.
Figures 13A, 13B, 13C:
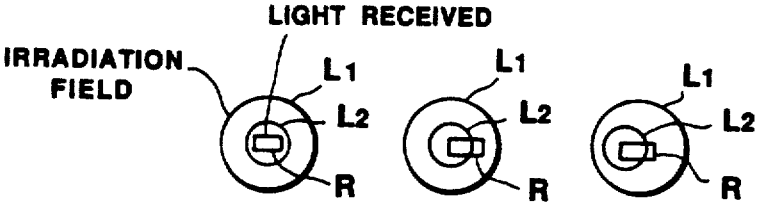
FIGS. 13*a*–13*c* are diagrams showing irregularity in the relation between the irradiation field of respective light-emitting elements and the position of light-receiving elements.

FIG. 6 shows an example of an electrical hardware circuit of a control section provided in association with the mechanical section of FIG. 5. This control section has a microcomputer including a CPU (central processing unit) 21, a program ROM 22 and a data and working RAM 23 and executes various processings under the control by this microcomputer. The output of the optical sensor 11 detecting insertion of the bill is supplied to a waveform rectifying circuit 24 which produces a signal "1" or "0" in response to presence or absence of a bill. This signal is applied to the CPU 21. Output signals of the optical sensors 12 and 13 for detecting the characterizing features of the bill are supplied to amplifying circuits 25 and 26 and, after amplification, are applied to channels cH1 and CH2 of an analog-to-digital converter 27, respectively. The analog-to-digital converter 27 converts the output analog signal of the optical sensors 12 and 13 applied to the channels cH1 and CH2 to digital data by a time division processing and supplies the converted digital signals to the CPU 21.

To the rotation shaft of the drive motor 18 is attached a rotary encoder 28 which generates incremental pulses or absolute angle detection value data in response to rotation of the motor 18. The output of this rotary encoder 28 is supplied to the CPU 21.

A standard pattern memory 29 stores standard pattern data corresponding to the pattern of a true bill. The standard pattern memory 29 stores standard pattern data in correspondence to the respective characterizing feature detection optical sensors 12 and 13. By way of example, it is assumed that the standard pattern data stored in this standard pattern memory 29 is transmitted light level data which has not been normalized.

A writable read-only memory (ROM) 30 consisting, for example, of an EPROM stores reference level data or data obtained by correcting this reference level data by initial paper-like piece absence level data for each apparatus. As a first example, reference level data itself is stored in this RPROM 30.

Description will first be made about a case where measures are taken for coping with the parts and assembling errors without taking the environmental change and aging into consideration. In this case, reference level data itself is stored in the EPROM 30. An example of processings executed in the CPU 21 in this case is shown in the flow charts of FIGS. 7 through 9.

Figure 7:
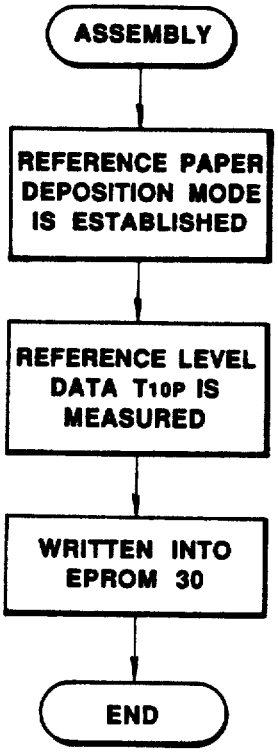
FIGS. 7 through 9 are flow charts showing an example of a program executed by a microcomputer section in FIG. 6.

Writing of the reference level data into the EPROM 30 is made by processings shown in FIG. 7. The processings of FIG. 7 are executed in the final stage of manufacturing and assembling of each bill validating apparatus.

First, a mode in which a reference paper having no particular pattern is deposited is established. Upon deposition of the reference paper, each reference level data is measured by the characterizing feature detection optical sensors 12 and 13. The measured reference level data are represented by reference characters T10*p*. The respective reference level data T10*p* measured by the optical sensors 12 and 13 are written and stored in the EPROM 30. Since the optical property of reference paper is uniform at any surface position thereof, reference level data T10*p* may be obtained representatively by either one of the optical sensors 12 and 13 instead of obtaining reference level data T10*p* by both of the optical sensors 12 and 13 and this single reference level data T10*p* may be stored in the EPROM 30 and used as reference level data T10*p* which is common to the optical sensors 12 and 13.

Next, processings during operation of the bill validating apparatus will be described with reference to the flow charts of FIGS. 8 and 9.

Figure 8:
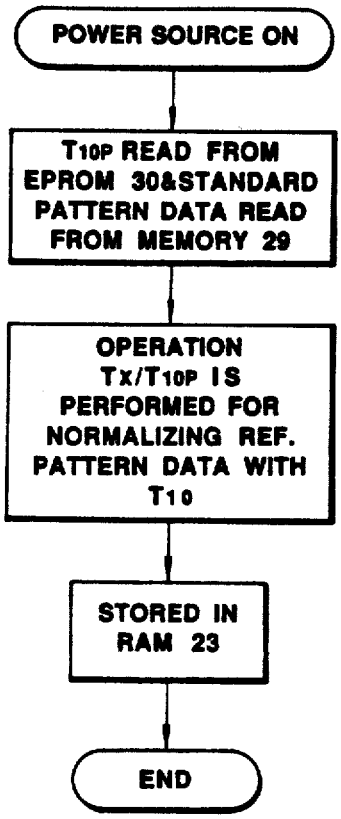

Upon turning on of a power source, the processings of FIG. 8 are executed. Reference level data T10*p*. corresponding to the characterizing feature detection optical sensors 12 and 13 are read from the EPROM 30 and standard pattern data corresponding to the optical sensors 12 and 13 are read from the data memory 29.

Then, an operation for normalizing the standard pattern data with the use of the reference level data T10*p* is performed for each of the characterizing feature detection optical sensors 12 and 13. Representing standard pattern data corresponding to each sample point of the bill by Tx (where x represents each sample point of the bill and, if the bill contains n sample points, x = 1, 2, . . . n), an operation Tx/T10*p* is performed with respect to each x. In other words, Tx/T10*p* is a ratio of the standard pattern data Tx corresponding to each sample point x to the reference level data T10*p* which is 100%.

Thereafter, the standard pattern data Tx/T10*p* which has been converted to the ratio to the reference level data T10*p* is stored in the RAM 23. These normalized standard pattern data Tx/T10*p* are stored in the RAM 23 in correspondence to the respective optical sensors 12 and 13. By this normalizing operation, the standard pattern data Tx/T10*p* which has been converted to the ratio to the reference level data T10*p* can be provided by reading it from the RAM 23.

Figure 9:
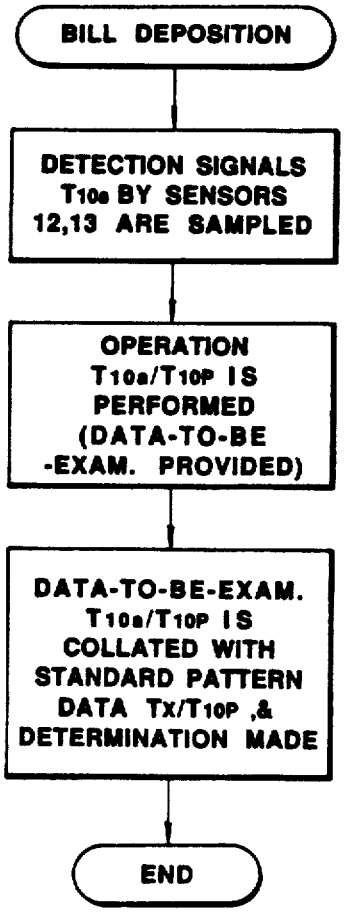

Upon deposition of a bill, processings of FIG. 9 are executed. First, detection signals produced by the characterizing feature detection optical sensors 12 and 13 are sampled and stored in predetermined areas in the RAM 23 as required. The level of the detection signal at a certain measuring sampling point A is represented by T10*a*.

Reference level data T10*p* corresponding to the characterizing feature detection sensors 12 and 13 are respectively read from the EPROM 30 and an operation "T10*a*/T10*p*" for converting the detection signal levels T10*a* corresponding to the respective optical sensors 12 and 13 to a ratio to the reference level data T10*p* is performed. In other words, T10*a*/T10*p* is the ratio of the detection signal level T10*a* to the reference level data T10*p* which is 100%. The operation result T10*a*T10*p* is stored in the RAM 23 as required. In this manner, data "T10*a*/T10*p*" which is the detection signal level T10*a* converted to its ratio to the reference level data T10*p* is provided as data to be examined.

Thereafter, the standard pattern data Tx/T10*p* stored in the RAM 23 by the processings of FIG. 8 is read out and the data to be examined "T10*a*/T10*p*" which has been obtained in the above described manner is collated with this standard pattern data Tx/T10*p*. This collation is made with respect to each measuring sample point in correspondence to the respective characterizing feature detection optical sensors 12 and 13 and determination as to whether the deposited bill is true or false is made on the basis of results of the collation.

In a modification of the above described embodiment, previously normalized data Tx/T10*p* may be prestored in the manufacturing process in a factory as standard pattern data stored in the data memory 29. In this case, the processings of FIG. 8 are omitted. In the above described embodiment in which the normalized standard pattern data Tx/T10*p* is obtained by the processings of FIG. 8, T10*p* differs one apparatus from another so that the standard pattern data Tx/T10*p* has a value peculiar to each apparatus. In a case where the standard pattern data Tx/T10*p* which has been normalized in the manufacturing process in the factory is stored as in the modified example, the common standard pattern data Tx/T10p is used in all apparatuses. Even in this case, the operation of the data to be examined T10a/T10p of FIG. 9 is performed for each apparatus in accordance with the reference level data T10p peculiar to each apparatus. Accordingly, the advantage of the present invention can be enjoyed in this case also.

Description will now be made about a case where measures are taken for coping with the environmental change and aging as well as the parts and assembling errors of the optical sensors. In this case, for coping with the environmental change and aging, paper-like piece absence level data which is an output of each of the characterizing feature detection optical sensors 12 and 13 produced when a bill is not deposited is measured and utilized for the control. For example, the EPROM 30 stores reference level correction data obtained by correcting reference level data by initial paper-like piece absence level data. An example of processings by the CPU 21 in this case is shown in flow charts of FIGS. 10 and 11.

Figure 10:
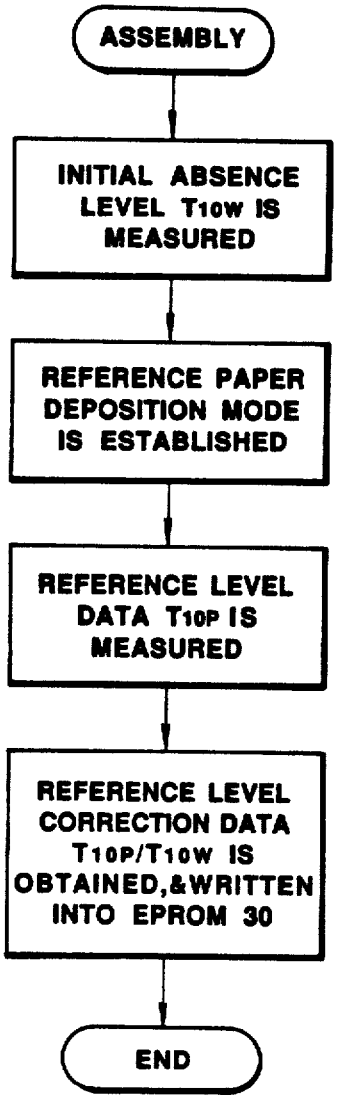
FIGS. 10 and 11 are flow charts showing another example of a program executed by the microcomputer section in FIG. 6.

FIG. 10 shows, as FIG. 7, writing of reference level data in the EPROM 30. This processing is made in the final stage of manufacturing and assembling of each bill validating apparatus.

In FIG. 10, as in FIG. 7, a reference paper having no particular pattern is deposited and reference level data T10p is measured. The processing of FIG. 10 is different from that of FIG. 7 in that the paper-like piece absence level data is measured on the basis of outputs of the characterizing feature detection optical sensors 12 and 13 produced when a bill is not deposited. The paper-like piece absence level data is obtained during the same period of time as the reference level data T10p is obtained. That is, the outputs of the characterizing feature detection optical sensors 12 and 13 are loaded as paper-like piece absence level data immediately before deposition of a reference paper or immediately after removal of a reference paper and are provided as initial paper-like piece absence level data T10W. The ratio T10p/T10W of the reference level data T10p to the initial paper-like piece absence level data T10W is then obtained and this ratio is written and stored in the EPROM 30. This reference level correction data T10p/T10W is obtained for each of the characterizing feature detection optical sensors 12 and 13 and stored in the EPROM 30.

Figure 11:
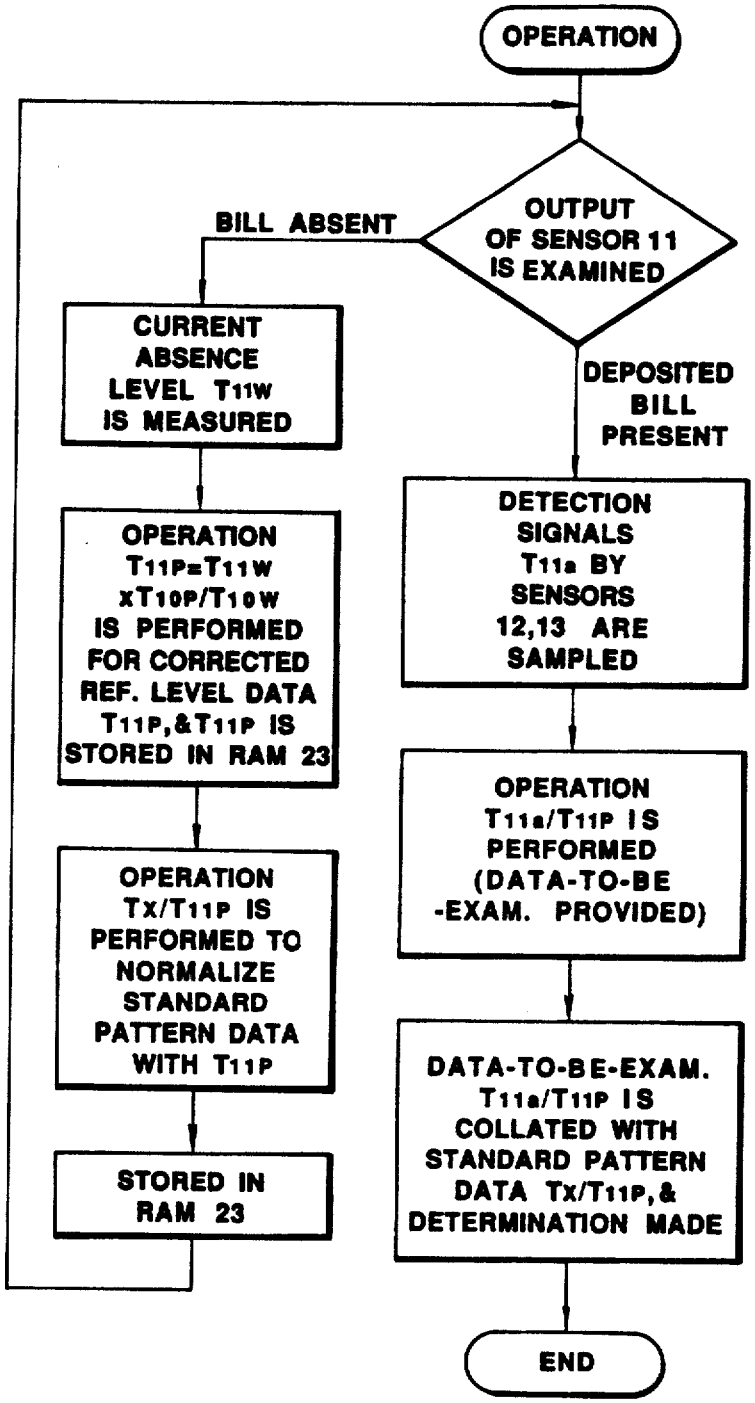

Referring to FIG. 11, processings executed when the bill validating apparatus is in operation will be described.

Upon turning on of the power source, processings of FIG. 11 are executed. In the processings of FIG. 11, the output of the deposition detection optical sensor 11 is examined and, if it is in a state where a bill is not detected, i.e., the stand-by mode, outputs of the characterizing feature detection sensors 12 and 13 are loaded and stored in the RAM 23 as current paper-like piece absence level data (represented by T11W).

Then, reference level correction data T10p/T10W corresponding to the characterizing feature detection optical sensors 12 and 13 are read from the EPROM 30 and operated with the current paper-like piece absence level data T11W corresponding to the optical sensors 12 and 13 to provide reference level data (represented by T11p) obtained by correcting reference level data by a ratio T11W/T10W of the current paper-like piece absence level data T11W to the initial paper-like piece absence level data T10W. The ratio T11W/T10W of the current paper-like piece absence level data T11W to the initial paper-like piece absence level data T10W corresponds to an output error of the optical sensor caused by the environmental change and aging. The reference level data T10p obtained at the time of assembling the apparatus is adjusted in accordance with this output error of the optical sensor caused by the environmental error and aging. The operation is made by multiplying the reference level correction data T10p/T10W with the current paper-like piece absence level data T11W. By this operation, $T11p = T11W \times T10p/T10w$ is obtained. This is $T11p = T10p \times T11W/T10W$ which is the product of the ratio T11W/T10W of the current paper-like piece absence level data T11W to the initial paper-like piece absence level data T10W and the reference level data T10p, and is obtained by correcting the reference level data T10p in accordance with the ratio T11W/T10W. In a case, for example, where there is no output error of the optical sensor caused by the environmental change and aging, $T11W = T10W$ so that $T11p = T11W \times T10p/T10W = T10p$ and hence the reference level data T10p is not corrected. If T11W is not equal to T10W, the initial reference level T10p is corrected in accordance with difference between T11W and T10W and this constitutes the corrected reference level data T11p. This corrected reference level data T11p is stored in the RAM 23.

Then, standard pattern data Tx corresponding to the characterizing feature detection optical sensors 12 and 13 are respectively read from the data memory 29 and the operation for normalizing the standard pattern data Tx with the use of the corrected reference level data T11p is made for the respective characterizing feature optical sensors 12 and 13. This operation consists of an operation Tx/T11p for each sample point x (where $x = 1, 2, 3, \ldots n$) in the same manner as the operation shown in FIG. 8. That is, Tx/T11p is the standard pattern data Tx for each sample point x which has been converted to its ratio to the corrected reference level data T11p which is 100%.

Thereafter, the standard pattern data Tx/T11p which has been converted to its ratio to the corrected reference level data T11p is stored in the RAM 23. The normalized standard pattern data Tx/T11p corresponding to the optical sensors 12 and 13 are stored in the RAM 23. The standard pattern data Tx/T11p which has been converted to the ratio to the corrected reference level data T11p by the normalizing operation is provided by reading it from the RAM 23.

Upon deposition of a bill, presence of the bill is detected in the step of output detection in the optical sensor 11 in FIG. 11 and, as in FIG. 9, the outputs of the characterizing feature detection optical sensors 12 and 13 are collated with the standard pattern data Tx/T11p of the RAM 23.

Detection signals produced by the characterizing feature detection optical sensors 12 and 13 are sampled and stored in predetermined areas in the RAM 23 as required. The level of the detection signals at a certain measuring sample point A is represented by T11a.

Then, the corrected reference level data T11p corresponding to the respective characterizing feature detection optical sensors 12 and 13 are read from the RAM 23 and an operation "T11a/T11p" for converting the detection signal levels T11a corresponding to the respective optical sensors 12 and 13 to ratios to the corrected reference level data T11p is performed. T11a/T11p is the detection signal T11a converted to its ratio to the corrected reference level data T11*p* which is 100%. The results of operation T11*a*/T11*p* are stored in the RAM 23 as required. Thus, the data "T11*a*/T11*p*" which is the detection signal level T11*a* converted to its ratio to the corrected reference level data T11*p* is provided as data to be examined.

Thereafter, the standard pattern data Tx/T11*p* stored in the RAM 23 by the processing in the stand-by mode is read out and the data to be examined "T11*a*/T11*p*" obtained in the above described manner is collated with the standard pattern data Tx/T11*p*. The collation is made at each measuring sample point with respect to each of the characterizing feature detection optical sensors 12 and 13 and whether the deposited bill is true or false is determined in accordance with the results of collation.

In the embodiment of FIGS. 10 and 11 also, previously normalized data Tx/T10*p* may be prestored in the data memory 29 in the manufacturing process in a factory as the standard pattern data to be stored in the data memory 29. In this case, Tx/T11*p* can be obtained by multiplying Tx/T10*p* with T10W/T11W in the processing in the stand-by mode in FIG. 11.

In the above described embodiments, the reference level data T10*p* or the corrected reference level data T10*p*/T10W is written and stored in the writable read-only memory 29. The invention is not limited to this but, for example, the reference level data T10*p*/T10W measured during assembling of the apparatus or the corrected reference level data T10*p*/T10W may be displayed at a suitable time so that the operator may watch this display and set and input the reference level data T10*p* or the corrected reference level data T10*p*/T10W in a digital or analog value by means of a digital switch or an analog setting device. In this case, during the operation of the bill validating apparatus, a program is made so that set contents of the digital switch or analog setting device may be referred to as required thereby to enable the operator to utilize the reference level data T10*p* or the corrected reference level data T10*p*/T10W.

In the above described embodiments, validation of a paper-like piece is made by the software processings. The validation may however be realized by using a wired hardware logic.

The deposition detection optical sensor 11 and the characterizing feature detection optical sensors 12 and 13 are not limited to optical sensors of a transmitted light measuring type but may also be optical sensors of a reflected light measuring type.

In the above described embodiments, description has been made about an apparatus which handles a bill or bank note. The invention however is applicable also to apparatuses which handle other paper-like pieces having a pattern corresponding to a certain value such as a draft like a bank draft, a note used as a substitute for money, a gift card and a bill made of plastics. As described above, since, according to the invention, the base for normalizing measured data for comparison and collation is not set at a saturation level but set at the level of a reference paper-like piece, validation becomes less vulnerable to adverse effects by the parts and assembling errors in an optical sensor whereby the validation accuracy can be improved. Further, since the reference level data is corrected in accordance with difference produced due to the environmental change and aging between the initial paper-like piece absence level data and the current paper-like piece absence level data, errors occurring in the optical type detection section due to the environmental change and aging can be eliminated or reduced.

What is claimed is:

1. An apparatus for validating a paper-like piece, comprising:

detection means including a sensor system of light transmission type for producing a detection signal corresponding to a pattern on an inserted reference paper-like piece by irradiating light on the paper-like piece;

reference level data providing means for preparing reference level data on the basis of a detection signal produced by said detection means in response to insertion of the reference paper-like piece on which no particular pattern is provided and providing this reference level data;

standard pattern providing means for providing a predetermined standard pattern corresponding to a pattern of a true paper-like piece;

data-to-be-examined providing means for providing data to be examined by modifying a detection signal produced by said detection means in response to deposition of a paper-like piece to be validated based upon the reference level data provided by said reference level data providing means; and determination means for determining whether the paper-like piece to be validated is true or false by collating the data to be examined provided by said data-to-be-examined providing means with the standard pattern provided by said standard pattern providing means.

2. An apparatus for validating a paper-like piece as defined in claim 1 further comprising:

paper-like piece absence level data providing means for providing paper-like piece absence level data in response to the output signal of said detection means produced when a paper-like piece is not deposited; and reference level data correction means for correcting the reference level data in accordance with the difference between initial paper-like piece absence level data which has been provided by said paper-like piece absence level data providing means during the same period of time as the reference level data has been obtained and current paper-like piece absence level data which has currently been provided by said paper-like piece absence level data providing means.

3. An apparatus for validating a paper-like piece as defined in claim 2 wherein said reference level data correction means comprises means for providing a ratio or deviation of the reference level data with respect to the initial paper-like piece level data to provide this ratio or deviation as reference level correction data and means for operating the current paper-like piece absence level data and the reference level correction data to obtain corrected reference level data.

4. An apparatus for validating a paper-like piece as defined in claim 1 or 2, wherein said standard pattern providing means modifies the standard pattern corresponding to the pattern on the normal paper-like piece in accordance with the reference level data.

5. An apparatus for validating a paper-like piece as defined in claim 4 wherein said reference level data providing means comprises means for obtaining the reference level data on the basis of the detection signal produced by said detection means in response to deposition of the paper-like piece having no particular pattern, and said standard pattern providing means comprises:

means for obtaining pattern data corresponding to the pattern of the true paper-like piece on the basis of the detection signal produced by said detection means in response to deposition of the true paper-like piece;

means for obtaining the reference pattern by modifying the pattern data in accordance with the reference level data; and means for storing at least one of the pattern data and standard pattern.

6. A collation method in a paper-like piece validating apparatus including detection means for producing a detection signal corresponding to a pattern on a deposited paper-like piece by irradiating light on the paper-like piece, for collating the detection signal produced by said detection means in response to deposition of the paper-like piece with a standard pattern, said method comprising;

a first step in which a reference paper-like piece having no particular pattern is inserted and reference level data is provided on the basis of a detection signal produced by said detection means in response to the insertion;

a second step in which a predetermined standard pattern corresponding to a pattern of a true paper-like piece is provided;

a third step in which the reference paper-like piece is removed before deposition of the paper-like piece to be validated;

a fourth step in which a detection signal produced by said detection means in response to the deposition of the paper-like piece to be validated is modified based upon the reference level data and this modified detection signal is provided as data to be examined; and a fifth step in which the data to be examined is collated with the standard pattern to determine whether the deposited paper-like piece is true or false.

7. A collation method in a paper-like piece validating apparatus as defined in claim 6 wherein said second step comprises:

a step in which a true paper-like piece is deposited and pattern data corresponding to a pattern of the paper-like piece is obtained on the basis of the detection signal produced by said detection means in response to deposition of the paper-like piece; and a step in which a standard pattern is obtained by modifying the pattern data in accordance with the reference level data.

8. A collation method in a paper-like piece validating apparatus as defined in claim 6 further comprising:

a fifth step in which initial paper-like piece absence level data is provided on the basis of an output signal produced by said detection means when a paper-like piece is not deposited during the same period as the reference level data is obtained;

a sixth step in which current paper-like piece absence level data is provided on the basis of an output signal produced currently by said detection section when a paper-like piece is not deposited; and a seventh step in which the reference level data used in said third step is corrected in accordance with the difference between the current paper-like piece absence level data and the initial paper-like piece absence level data.

9. A collation method in a paper-like piece validating apparatus as defined in claim 6, wherein said detection signal of said first step is produced by said detection means which includes a sensor system of light transmission type.

* * * * *